US008615327B2

(12) United States Patent
Takagi et al.

(10) Patent No.: US 8,615,327 B2
(45) Date of Patent: Dec. 24, 2013

(54) DEVICE AND METHOD FOR HUMIDITY ESTIMATION

(75) Inventors: Yasuo Takagi, Chigasaki (JP); Koichi Ikeda, Yamato (JP); Yukio Hiraoka, Inagi (JP); Hisashi Kobayashi, Kawaguchi (JP); Akihiro Fujii, Tokorozawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 302 days.

(21) Appl. No.: 12/903,640

(22) Filed: Oct. 13, 2010

(65) Prior Publication Data

US 2011/0088455 A1 Apr. 21, 2011

(30) Foreign Application Priority Data

Oct. 15, 2009 (JP) ..... P2009-238557

(51) Int. Cl.

| | |
|---|---|
| ***G01M 1/38*** | (2006.01) |
| ***G05B 13/00*** | (2006.01) |
| ***G05B 15/00*** | (2006.01) |
| ***F25B 41/06*** | (2006.01) |
| ***F25B 1/00*** | (2006.01) |
| ***F25B 49/00*** | (2006.01) |
| ***G01K 13/00*** | (2006.01) |

(52) U.S. Cl.
USPC ..... 700/276; 700/277; 700/278; 62/527; 62/498; 62/129; 62/228.1

(58) Field of Classification Search
USPC ..... 700/276–278; 62/527, 498, 129, 228.1
See application file for complete search history.

(56) References Cited

U.S. PATENT DOCUMENTS 7,343,226 B2 * 3/2008 Ehlers et al. ..... 700/276
7,516,622 B2 * 4/2009 Gauthier et al. ..... 62/157
(Continued)

FOREIGN PATENT DOCUMENTS

| | | |
|---|---|---|
| JP | 8-5126 | 1/1996 |
| JP | 2006-304595 | 11/2006 |

(Continued)

OTHER PUBLICATIONS

Notification of Reasons for Refusal issued by the Japanese Patent Office on Sep. 20, 2011, for Japanese Patent Application No. 2009-238557, and English-language translation thereof.

(Continued)

*Primary Examiner* — Kavita Padmanabhan
*Assistant Examiner* — Jason Lin
(74) *Attorney, Agent, or Firm* — Finnegan, Henderson, Farabow, Garrett & Dunner, L.L.P.

(57) ABSTRACT

A humidity estimation device connected with an air-conditioner includes a charge airflow rate estimation (CARE) unit, a charge air absolute humidity estimation (CAAHE) unit, an indoor generated vapor amount estimation (IGVAE) unit, and an indoor absolute humidity estimation (IAHE) unit. The CARE unit calculates an estimated charge airflow rate (ECAR) of the air-conditioner based on operation control information of the charge fan and a preset fan differential pressure. The CAAHE unit calculates an estimated charge air absolute humidity (ECAAH) of the air-conditioner based on a charge air temperature and a preset charge air relative humidity. The IGVAE unit calculates an estimated indoor generated vapor amount (EIGVA) based on an indoor temperature, the number of persons in the room and activity index values of the persons. The IAHE unit calculates an estimated absolute humidity in the room based on the ECAR, the ECAAH and the EIGVA.

5 Claims, 3 Drawing Sheets

(56) References Cited

U.S. PATENT DOCUMENTS

| | | | | |
|---|---|---|---|---|
| 7,757,504 | B2 | 7/2010 | Yonezawa et al. | |
| 8,374,725 | B1 * | 2/2013 | Ols | 700/277 |
| 2005/0121185 | A1 * | 6/2005 | Yonekura et al. | 165/202 |
| 2005/0265741 | A1 * | 12/2005 | Otsuka | 399/69 |
| 2006/0032248 | A1 * | 2/2006 | Kates | 62/129 |
| 2007/0022770 | A1 * | 2/2007 | Liu | 62/228.1 |
| 2007/0180851 | A1 * | 8/2007 | Fujiyoshi et al. | 62/480 |
| 2008/0234869 | A1 | 9/2008 | Yonezawa et al. | |
| 2009/0056359 | A1 * | 3/2009 | Germagian | 62/259.2 |
| 2009/0134231 | A1 * | 5/2009 | Matsui | 236/44 A |
| 2010/0006662 | A1 | 1/2010 | Yonezawa et al. | |
| 2010/0023167 | A1 | 1/2010 | Ito et al. | |
| 2010/0036533 | A1 * | 2/2010 | Masuda et al. | 700/278 |

FOREIGN PATENT DOCUMENTS

| | | | |
|---|---|---|---|
| JP | 2006-331372 | | 12/2006 |
| JP | 2008-76000 | | 4/2008 |
| JP | 2008196842 | A * | 8/2008 |
| JP | 2008-232511 | | 10/2008 |
| JP | 2008232511 | A * | 10/2008 |
| JP | 2009-175952 | | 8/2009 |
| JP | 2010-249492 | | 11/2010 |

OTHER PUBLICATIONS

Notification of Reasons for Refusal issued by the Japanese Patent Office on Jun. 5, 2012, for Japanese Patent Application No. 2009-238557, and English-language translation thereof.

Yonezawa, K. et al., "Air conditioning Control System," U.S. Appl. No. 12/864,680, filed Jul. 27, 2010.

Notification of the First Office Action issued by the State Intellectual Property Office of the People's Republic of China on Jan. 4, 2013, for Chinese Patent Application No. 201010510804.8, and English-language translation thereof.

Notification of the Second Office Action issued by The State Intellectual Property Office of the People's Republic of China on Sep. 30, 2013, for Chinese Patent Application No. 201010510804.8, and English-language translation thereof.

* cited by examiner

DEVICE AND METHOD FOR HUMIDITY ESTIMATION

CROSS-REFERENCE TO RELATED APPLICATION

This application is based upon and claims the benefit of priority from Japanese Patent Application No. 2009-238557, filed Oct. 15, 2009; the entire contents of which are incorporated herein by reference.

FIELD

Embodiments described herein relate generally to a device and a method for humidity estimation that estimate an indoor humidity value to be used for calculating air-conditioning parameters in an air-conditioner that controls air-conditioning within a building such as a hospital.

BACKGROUND

Generally, energy consumption relating to air-conditioning occupies a half of energy consumption for all building equipments. Therefore, promotion of energy saving for air-conditioning highly contributes to energy saving for entire of building equipments.

Meanwhile, it is required to satisfy sensation of warmth (i.e. comfort) of persons in an amenity space such as a room in a business building. Though ensuring comfort has aspects opposing against energy saving, energy waste can be saved by restraining excessive energy consumption beyond a range where persons in a room feel comfortable.

Therefore, a control using a comfort index called as PMV is widely adopted for contamination of comfort and energy saving. Hereinafter, the comfort index "PMV" will be explained.

The PMV is a comfort index calculated by use of parameters (a) air temperature, (b) relative humidity, (c) mean radiant temperature, (d) airflow speed, (e) activity index value [index of heat generation within human body], and (f) amount of clothing that affects a human sensation of warmth with respect to heat and cold.

An amount of heat generation in a human is a sum of an amount of convective radiation, an amount of heat radiation in heat radiation, an amount of evaporative heat, an amount of heat radiation through breathings, and an amount of stored heat. When an equation of thermal equilibrium with respect to these is satisfied, a human body is thermally neutral and in a comfortable state that is not too hot and too cold. On the other hand, a human body feels heat and cold when the equation of thermal equilibrium becomes invalid.

Professor Fanger at the Technical University of Denmark released an introduction of a comfort equation in 1967. This being as a start point, a thermal load to a human body and a human sensation for heat and cold were associated each other through statistical analyses of questionnaires to many European and American examinees, so that the PMV (Predicted Mean Vote) was proposed. This was got into the ISO standard and then frequently used in recent days.

The PMV as an index of sensation of heat and cold is presented with a value using next seven-grade evaluation scale.

+3 Hot
+2 Warm
+1 Slightly warm
0 Neutral
−1 Slightly cool

−2 Cool
−3 Cold

Among the above-mentioned parameters, the activity index value that represents work intensity is generally used with a unit of a metabolism amount "met", and the amount of clothing is used with a unit "clo".

The unit "met" represents a metabolism amount and 1 met is defined with a following equation (1) based on a metabolism amount under resting condition in a thermally comfort state.

$$1\ \text{met}=58.2\ \text{W/m}^2=50\ \text{kcal/m}^2\cdot\text{h} \tag{1}$$

In addition, the unit "clo" represents a thermally insulation property of clothing and 1 clo is a value such that an amount of heat radiation from a surface of a human body in a room (21° C. of air temperature, 50% of relative humidity and not more than 5 cm/s of airflow speed) equilibrates with a metabolic amount of 1 met. It is defined with a following equation (2) based on a conversion to a normal thermal resistance value.

$$1\ \text{clo}=0.155\ \text{m}^2\cdot{}^\circ\text{C./W}=0.18\ \text{m}^2\cdot\text{h}\cdot{}^\circ\text{C./kcal} \tag{2}$$

An air-conditioning load can be reduced to save energy by setting a PMV target value within a comfortable range ($-0.5<\text{PMV}<+0.5$) using a following equation (3) so that it is set toward a hot side when cooling or toward a cold side when heating.

$$\text{PMV}=(0.352e^{-0.042M/A}+0.032)\cdot L \tag{3}$$

M: activity index value [kcal]

A: surface area of human body [$m^2$]

L: thermal load to human body [$kcal/m^2\cdot h$] (calculated from the Fanger's comfort equation)

e: base of natural logarithm

A patent document 1 (Japanese Patent Application Laid-opened No. 2006-331372) discloses environmental energy management system that achieves energy saving while ensuring comfort of persons in a room using the PMV and so on. The system is configured with an apparatus to which an agent technique is applied. The system achieves both of optimization of indoor thermal environment and minimization of energy consumption according to a control function for air-conditioning equipments based on functions of the agent apparatus (i.e. an autonomous control function, a logical group function, and a hierarchization function) and functions of a management apparatus (i.e. a data acquisition function from the agent apparatus, an integrated management/control function for the agent apparatus, and a calculation function of the thermal environment and the energy optimization).

SUMMARY

Although many parameters that affect human comfort exist, such as temperature, humidity, airflow speed or the like, both of optimization of indoor thermal environment and minimization of energy consumption are achieved in the above-mentioned environmental energy management system disclosed in the patent document 1 by the control function for air-conditioning equipments that utilizes the agent function based on the calculation function of the thermal environment and the energy optimization, and their calculation results.

However, since comfort that a person feels depends not only on the thermal environment but also on humidity, a control of humidity environment is also desired. But no humidity measurement instrument is equipped in many buildings. Therefore, it is hard to perform a control of humidity environment.

An object of embodiments is to provide a device and a method for humidity estimation that can estimate an indoor humidity value to be used for air-conditioning even in a building where no humidity measurement instrument is equipped.

A first aspect of the present invention provides a humidity estimation device connected with an air-conditioner that includes a charge airflow rate estimation unit, a charge air absolute humidity estimation unit, an indoor generated vapor amount estimation unit, and an indoor absolute humidity estimation unit. The charge airflow rate estimation unit acquires operation control information of a charge fan of the air-conditioner and calculates an estimated charge airflow rate of the air-conditioner based on the operation control information of the charge fan and a preset fan differential pressure. The charge air absolute humidity estimation unit acquires a charge air temperature value of the air-conditioner and calculates an estimated charge air absolute humidity of the air-conditioner based on the charge air temperature value and a preset charge air relative humidity. The indoor generated vapor amount estimation unit that acquires an indoor temperature value of a room that is an object controlled by the air-conditioner and calculates an estimated indoor generated vapor amount based on the indoor temperature value, the number of persons in the room and activity index values of the persons that are input. The indoor absolute humidity estimation unit that calculates an estimated absolute humidity in the room based on the estimated charge airflow rate calculated by the charge airflow rate estimation unit, the estimated charge air absolute humidity calculated by the charge air absolute humidity estimation unit and the estimated indoor generated vapor amount calculated by the indoor generated vapor amount estimation unit.

A second aspect of the present invention provides a humidity estimation method for estimating humidity in a room in which an air-conditioner is equipped. The method includes: acquiring operation control information of a charge fan of the air-conditioner; calculating an estimated charge airflow rate of the air-conditioner based on the operation control information of the charge fan and a preset fan differential pressure; acquiring a charge air temperature value of the air-conditioner; calculating an estimated charge air absolute humidity of the air-conditioner based on the charge air temperature value and a preset charge air relative humidity; acquiring an indoor temperature value of the room; calculating an estimated indoor generated vapor amount based on the indoor temperature value, the number of persons in the room and activity index values of the persons that are input; and calculating an estimated absolute humidity in the room based on the estimated charge airflow rate, the estimated charge air absolute humidity and the estimated indoor generated vapor amount.

According to the above aspects of the present invention, an indoor humidity value to be used for air-conditioning can be estimated even in a building where no humidity measurement instrument is equipped.

DETAILED DESCRIPTION OF EMBODIMENTS (Configuration of Device for Humidity Estimation)

Figure 1:
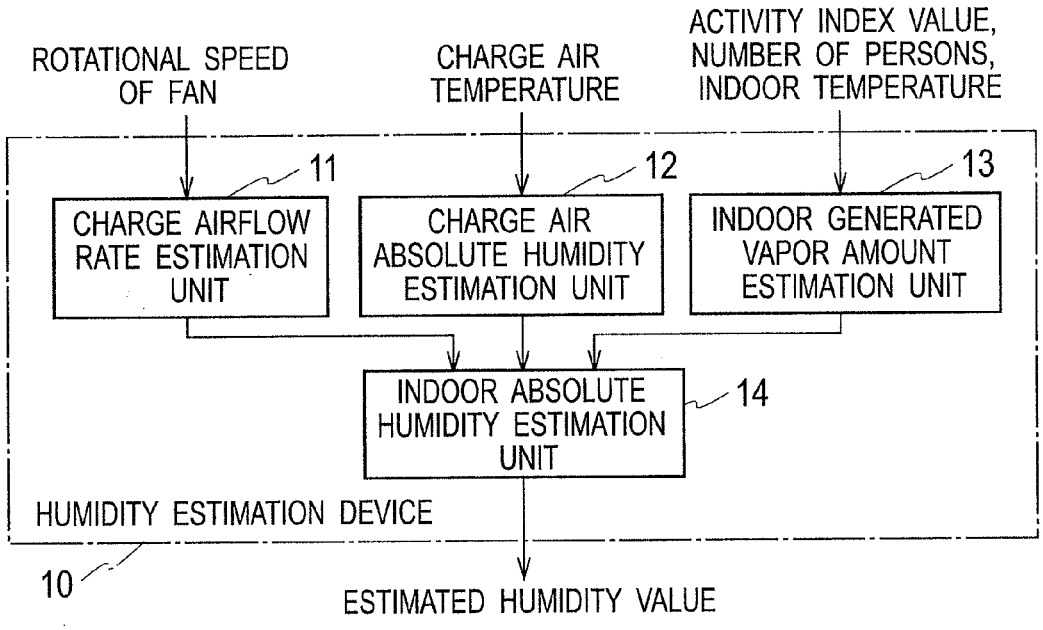
FIG. 1 is a block diagram of a device for humidity estimation according to an embodiment.

Hereinafter, configuration of an embodiment of a humidity estimation device 10 will be explained with reference to FIG. 1.

The humidity estimation device 10 is provided in an air-conditioner for a room in a building. The humidity estimation device 10 includes a charge airflow rate estimation unit 11, a charge air absolute humidity estimation unit 12, an indoor generated vapor amount estimation unit 13, and an indoor absolute humidity estimation unit 14. Plural (n number of) air-conditioners 1 to n are provided in a room that is a controlled object for air-conditioning.

The charge airflow rate estimation unit 11 acquires each controlled rotational speed of charge fans as operation control information from DDCs (Direct Digital Controllers: not shown) or the like in the air-conditioners 1 to n. Then, the charge airflow rate estimation unit 11 calculates each charge airflow rate of the air-conditioners 1 to n based on the rotational speed and a preset fan differential pressure.

The charge air absolute humidity estimation unit 12 acquires each controlled charge air temperature value from the DDCs or the like in the air-conditioners 1 to n. Then, the charge air absolute humidity estimation unit 12 calculates each estimated charge air absolute humidity value of the air-conditioners 1 to n based on the charge air temperature value and a preset charge air relative humidity value.

The indoor generated vapor amount estimation unit 13 acquires an indoor temperature value from a temperature sensor provided in the room of the controlled object for air-conditioning. Then, the indoor generated vapor amount estimation unit 13 calculates an estimated indoor generated vapor amount based on the indoor temperature value and the number of persons in the room and their activity index values that are input.

The indoor absolute humidity estimation unit 14 calculates an estimated humidity value of the room based on the charge airflow rate of each of the air-conditioners 1 to n calculated by the charge airflow rate estimation unit 11, the estimated charge air absolute humidity value of each of the air-conditioners 1 to n calculated by the charge air absolute humidity estimation unit 12 and the estimated indoor generated vapor amount calculated by the indoor generated vapor amount estimation unit 13.

(Operation of Device for Humidity Estimation)

Figure 2:
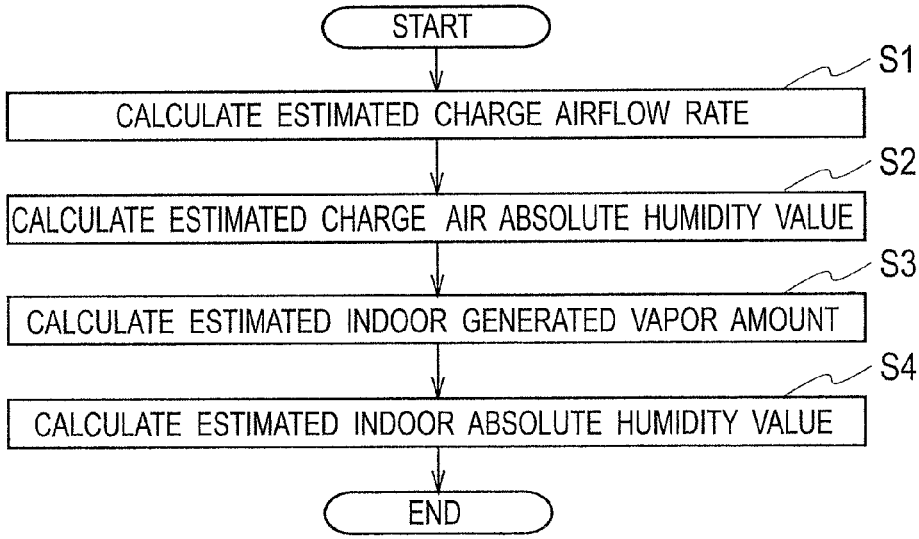
FIG. 2 is a flowchart showing operations of the device for humidity estimation.

Next, operation of the embodiment of the humidity estimation device 10 will be explained with reference to FIG. 2.

First, each controlled rotational speed of the charge fans as the operation control information from the DDCs or the like in the air-conditioners 1 to n by the charge airflow rate estimation unit 11. The rotational speed is indicated by its percentage when its maximum rotational speed is defined as 100%. Then, the charge airflow rate estimation unit 11 calculates each charge airflow rate of the air-conditioners 1 to n based on the rotational speed and the preset fan differential pressure (step S1).

Figure 3:
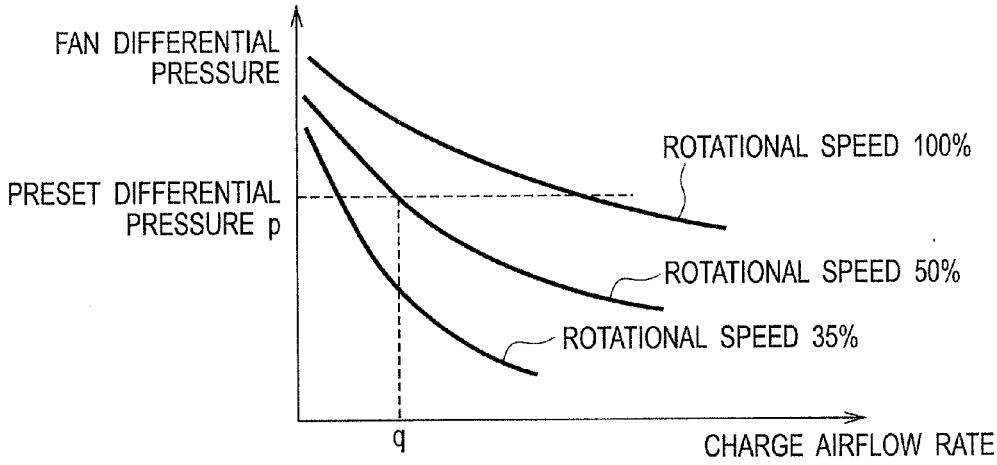
FIG. 3 is a graph showing information of a charge airflow rate table stored in a charge airflow rate estimation unit of the device for humidity estimation.

In the charge airflow rate estimation unit 11, stored is a charge airflow rate table as shown in FIG. 3 in which relationship between the fan differential pressure and the charge airflow rate are defined in association with variation of the rotational speeds of the charge fan (e.g. rotational speeds 35%, 50% and 100% when the maximum speed is defined as 100%). For example, when the acquired rotational speed of the charge fan is 50% and the preset differential pressure takes a value p, the estimated charge airflow rate is determined as a charge airflow rate q based on the charge airflow rate table shown in FIG. 3. The charge airflow rate table is preliminarily prepared for each charge fan of the air-conditioners 1 to n based on its fan property.

In addition, each controlled charge air temperature value is acquired from the DDCs or the like in the air-conditioners 1 to n by the charge air absolute humidity estimation unit 12. Then, the charge air absolute humidity estimation unit 12 calculates each estimated charge air absolute humidity value of the air-conditioners 1 to n based on the charge air temperature value and the preset charge air relative humidity value (step S2).

Figure 4:
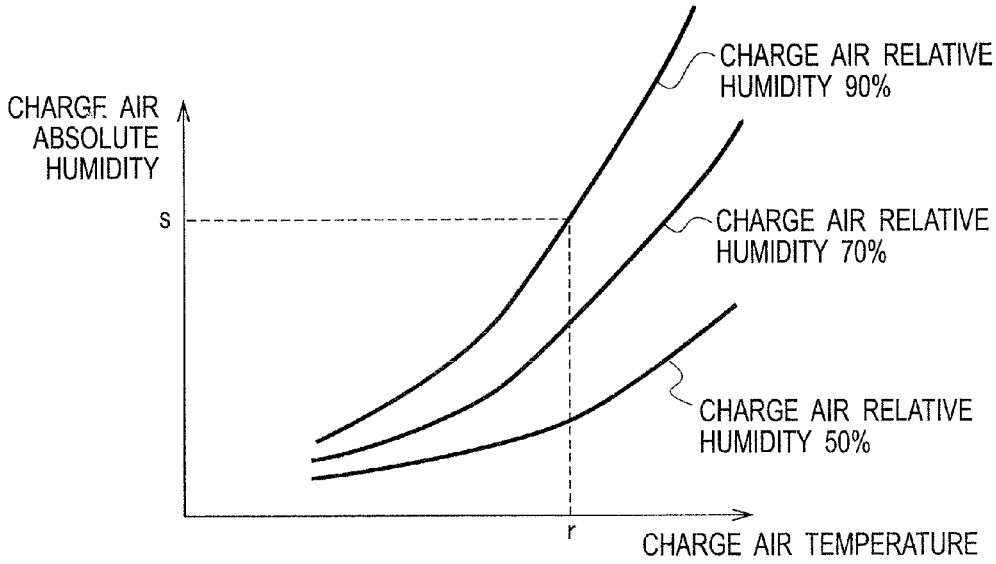
FIG. 4 is a graph showing information of a charge air humidify table stored in a charge air absolute humidity estimation unit of the device for humidity estimation.

In the charge air absolute humidity estimation unit 12, stored is a charge air relative humidity table as shown in FIG. 4 in which relationship between the charge air temperature value and the charge air absolute humidity value in association with variation of the charge air relative humidity values (e.g. relative humidity values 50%, 70% and 90%). For example, when the acquired charge air temperature value is r ° C. and the preset charge air relative humidity value is 90%, the estimated charge air absolute humidity value is determined as an absolute humidity value s based on the charge air relative humidity table shown in FIG. 4. The charge air relative humidity table is a part of the Psychrometric Chart and fixed information that doesn't change according to conditions.

In addition, the indoor temperature value is acquired from the temperature sensor provided in the room of the controlled object for air-conditioning by the indoor generated vapor amount estimation unit 13. Then, the indoor generated vapor amount estimation unit 13 calculates the estimated indoor generated vapor amount based on the indoor temperature value and the number of persons in the room and their activity index values that are input (step S3).

Figure 5:
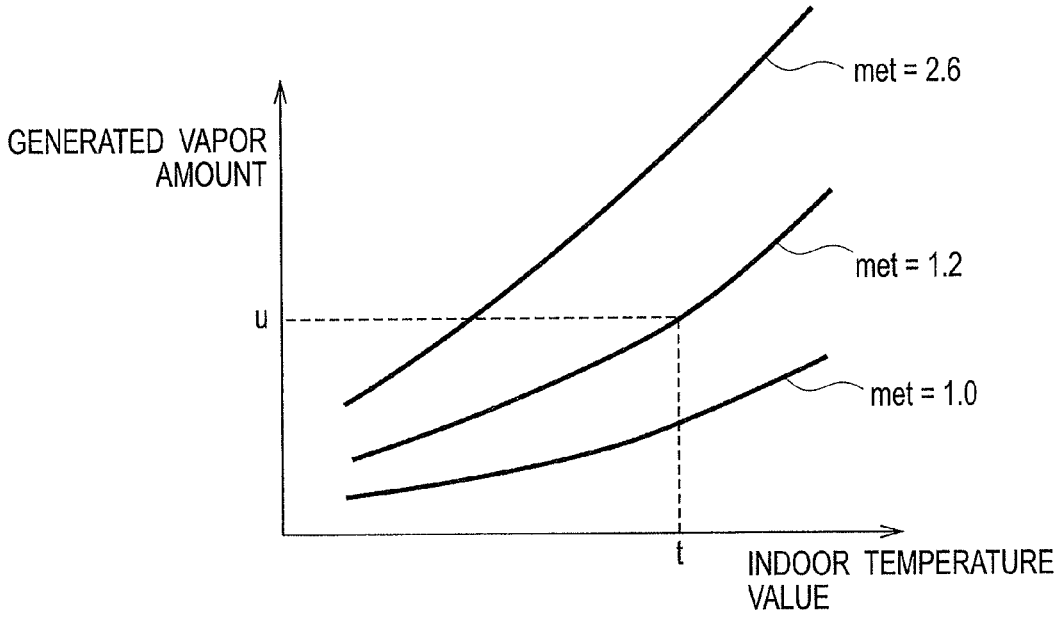
FIG. 5 is a graph showing information of a generated vapor amount table stored in an indoor generated vapor amount estimation unit of the device for humidity estimation.

In the indoor generated vapor amount estimation unit 13, stored is a generated vapor amount table as shown in FIG. 5 in which relationship between the indoor temperature value and a generated vapor amount to be generated from one person in association with variation of the activity index values (e.g. met=1.0, 1.2 and 2.6). For example, when the acquired indoor temperature value is t ° C. and the preset activity index value "met" according to the activity state of the persons in the room is 1.2, an estimated generated vapor amount per one person is determined as an generated vapor amount u based on the generated vapor amount table shown in FIG. 5. Then the indoor estimated generated vapor amount in the room for the controlled object for air-conditioning is calculated by multiplying the determined estimated generated vapor amount per one person by the number of persons in the room.

Next, the estimated humidity value $H_r$ of the room is calculated by the indoor absolute humidity estimation unit 14 based on a following equation (4) to which the charge airflow rate of each of the air-conditioners 1 to n calculated by the charge airflow rate estimation unit 11, the estimated charge air absolute humidity value of each of the air-conditioners 1 to n calculated by the charge air absolute humidity estimation unit 12 and the estimated indoor generated vapor amount calculated by the indoor generated vapor amount estimation unit 13 are applied (step S4).

$$H_r=((lw/\rho)+F^1_{sa}H^1_{sa}+\ldots+F^n_{sa}H^n_{sa})/(F^1_{sa}+\ldots+F^n_{sa}) \quad (4)$$

ρ: density of air [kg/m$^3$]

$F^1_{sa}, F^2_{sa} \ldots F^n_{sa}$: each estimated charge airflow rate of the air-conditioners 1 to n [m$^3$/h]

$H^1_{sa}, H^2_{sa} \ldots H^n_{sa}$: each estimated charge air humidity of the air-conditioners 1 to n [kg/kgDA]

lw: estimated indoor generated vapor amount [kg/h]

Based on the above equation (4), the estimated humidity value $H_r$ is presented by a vapor amount per unit of a charge airflow rate by dividing a sum of the vapor amount generated from the persons in the room of the controlled object for air-conditioning and the vapor amount included in the charge air by a sum of the charge airflow.

Then, the PMV is calculated for each of the air-conditioned 1 to n using the estimated humidity value of the room estimated in this manner and thereby the calculated PMV is utilized for air-conditioning for the room of the controlled object for the air-conditioning.

According to the above embodiment, the indoor absolute humidity value can be estimated even in a building in which where no humidity measurement instrument is equipped. Therefore, air-conditioning control in the light of not only indoor temperature but also indoor humidity can be achieved by utilizing the estimated indoor absolute humidity value. As a result, the humidity estimation device 10 contributes to the achievement of both of optimization of indoor thermal environment and minimization of energy consumption.

In the above embodiment, the charge airflow rate table with the rotational speeds 35%, 50% and 100% is shown in FIG. 3. When the rotational speed takes another value other than these rotational speeds 35%, 50% and 100%, the charge airflow rate can be estimated by a value calculated through a compensation process based on given values of these rotational speeds 35%, 50% and 100%.

In addition, in the above embodiment, the charge air relative humidity table with the relative humidity values 50%, 70% and 90% is shown in FIG. 4. When the relative humidity takes another value other than these relative humidity value 50%, 70% and 90%, the charge air humidity value can be estimated by a value calculated through a compensation process based on given values of these relative humidity values 50%, 70% and 90%.

In addition, in the above embodiment, the generated vapor amount table with the activity index values (met=1.0, 1.2 and 2.6) is shown in FIG. 5. When the input activity index value takes another value other than these activity index values (met=1.0, 1.2 and 2.6), the generated vapor amount can be estimated by a value calculated through a compensation process based on these given activity index values (met=1.0, 1.2 and 2.6).

Further, in the above embodiment, each rotational speed of the charge fans are used as the operation control information when calculating the estimated charge airflow rate. However, the estimated charge airflow rate may be calculated based on frequency values for controlling the charge fans each driven with an inverter. In this case, relationship between the fan differential pressure and the charge airflow rate are defined in the charge airflow rate table in association with variation of the frequency values for controlling the charge fans each driven with an inverter.

Alternatively, the estimated charge airflow rate may be calculated based on information that indicates operation modes (e.g. "high mode", "medium mode" or "low mode") of the charge fans. In this case, relationship between the fan differential pressure and the charge airflow rate are defined in the charge airflow rate table in association with variation of the operation modes.

What is claimed is:

1. A humidity estimation device connected with an air-conditioner, the device comprising:

a charge airflow rate estimation unit that acquires operation control information of a charge fan of the air-conditioner and calculates an estimated charge airflow rate of the air-conditioner based on the operation control information of the charge fan and a preset fan differential pressure;

a charge air absolute humidity estimation unit that acquires a charge air temperature value of the air-conditioner and calculates an estimated charge air absolute humidity of the air-conditioner based on the charge air temperature value and a preset charge air relative humidity;

an indoor generated vapor amount estimation unit that acquires an indoor temperature value of a room that is an object controlled by the air-conditioner and calculates an estimated indoor generated vapor amount based on the indoor temperature value, a number of persons in the room and activity index values of the persons that are input; and an indoor absolute humidity estimation unit that calculates an estimated absolute humidity in the room based on the estimated charge airflow rate calculated by the charge airflow rate estimation unit, the estimated charge air absolute humidity calculated by the charge air absolute humidity estimation unit and the estimated indoor generated vapor amount calculated by the indoor generated vapor amount estimation unit.

2. The humidity estimation device according to claim 1, wherein a plurality of air-conditioners is provided in the room, the charge airflow rate estimation unit calculates each estimated charge airflow rate of the plurality of air-conditioners, the charge air absolute humidity estimation unit calculates each estimated charge air absolute humidity of the plurality of air-conditioners, and the indoor absolute humidity estimation unit calculates the estimated absolute humidity based on all of the each estimated charge airflow rate of the plurality of air-conditioners calculated by the charge airflow rate estimation unit, all of the each estimated charge air absolute humidity of the plurality of air-conditioners calculated by the charge air absolute humidity estimation unit and the estimated indoor generated vapor amount calculated by the indoor generated vapor amount estimation unit.

3. The humidity estimation device according to claim 1, wherein the operation control information of the charge fan is one of rotational speed of the charge fan, a frequency value for controlling the charge fan driven with an inverter, and a selected operation mode from among a plurality of predetermined operation modes of the charge fan.

4. A humidity estimation method for estimating humidity in a room in which an air-conditioner is equipped, the method comprising:

acquiring operation control information of a charge fan of the air-conditioner;

calculating an estimated charge airflow rate of the air-conditioner based on the operation control information of the charge fan and a preset fan differential pressure;

acquiring a charge air temperature value of the air-conditioner;

calculating an estimated charge air absolute humidity of the air-conditioner based on the charge air temperature value and a preset charge air relative humidity;

acquiring an indoor temperature value of the room;

calculating an estimated indoor generated vapor amount based on the indoor temperature value, a number of persons in the room and activity index values of the persons that are input; and calculating an estimated absolute humidity in the room based on the estimated charge airflow rate, the estimated charge air absolute humidity and the estimated indoor generated vapor amount.

5. The humidity estimation method according to claim 4, wherein a plurality of air-conditioners is provided in the room, each estimated charge airflow rate is calculated for the plurality of air-conditioners, each estimated charge air absolute humidity is calculated for the plurality of air-conditioners, and the estimated absolute humidity is calculated based on all of the each estimated charge airflow rate of the plurality of air-conditioners, all of the each estimated charge air absolute humidity of the plurality of air-conditioners and the estimated indoor generated vapor amount.

* * * * *